United States Patent [19]

Ribnitz

[11] Patent Number: 4,759,946

[45] Date of Patent: Jul. 26, 1988

[54] METHOD AND APPARATUS FOR THE INTERIOR COATING OF HOLLOW BODIES

[76] Inventor: Peter Ribnitz, Haselstr. 15, 9013 St. Gallen, Switzerland

[21] Appl. No.: 889,108

[22] Filed: Jul. 24, 1988

Related U.S. Application Data

[63] Continuation of Ser. No. 752,678, Jul. 8, 1985, abandoned.

[30] Foreign Application Priority Data

Jul. 6, 1984 [CH] Switzerland ..... 3269/84

[51] Int. Cl.[4] ..... B05D 7/22; B05C 11/00; B05B 7/00

[52] U.S. Cl. ..... 427/8; 118/58; 118/302; 118/306; 118/308; 118/317; 118/324; 118/326; 118/621; 118/622; 118/642; 118/667; 118/712; 427/27; 427/28; 427/30; 427/55; 427/230; 427/235; 427/236; 427/239; 427/314; 427/318; 427/385.5; 427/388.1

[58] Field of Search ..... 427/239, 235, 314, 318, 427/236, 8, 55, 424, 421, 27, 28, 385.5, 30, 350, 220, 388.1; 118/DIG. 3, 58, 667, 712, 621, 622, 642, 306, 308, 317, 324, 326, DIG. 10

[56] References Cited

U.S. PATENT DOCUMENTS

| | | | |
|---|---|---|---|
| 3,077,171 | 2/1963 | Gotsch et al. | 118/317 |
| 3,526,027 | 9/1970 | Manuel et al. | 118/317 |
| 3,535,144 | 10/1970 | Gunderman et al. | 427/55 |
| 3,702,107 | 11/1972 | Road et al. | 118/317 |
| 4,107,359 | 8/1978 | Witt et al. | 427/239 |
| 4,370,944 | 2/1983 | Nagata et al. | 118/317 |

*Primary Examiner*—Janyce A. Bell

*Attorney, Agent, or Firm*—Antonelli, Terry & Wands

[57] ABSTRACT

A method and an apparatus for interior coating of hollow bodies comprising a mandrel introducible into at least one tubular body, a coating arrangement on the mandrel for applying a coating medium to an interior of the tubular body and a heating mechanism on the mandrel and arranged so as to predominantly deliver heat directly from the mandrel into a surrounding area toward the tublular body. The heat-applying efficiency of burning in a coating medium can be improved by applying the heat from the interior at least predominantly directly to one of an interior area of the tubular body just before being coated and an interior area of the body already coated to burn in the coating according to the disclosed method.

12 Claims, 2 Drawing Sheets

METHOD AND APPARATUS FOR THE INTERIOR COATING OF HOLLOW BODIES

This is a continuation of application Ser. No. 752,678, filed July 8, 1985, now abandoned.

BACKGROUND OF THE INVENTION

The present invention relates to a method for the interior coating of hollow bodies by means of applying a coating medium and with the help of heat which is applied to the body as well as an apparatus to perform this method, said apparatus comprising an arm over which the bodies are moved and whereby there is further provided a coating arrangement on said arm.

Problems which occur for instance with respect to corrosion at joined edges of hollow bodies, joined e.g. by soldering or welding, of bodies as of metal sheet material for the manufacture e.g. of cans are known since long. For the solution of these problems the CH PS No. 444 632 proposes after the edges having been welded, to provide soldering over the welding seam so that the solder, flowing over the welding seam provides for a corrosion protective layer. This patent further proposes to coat additionally the seam with the help of a coating nozzle to further enhance corrosion protection. The metal sheet which is, after having been welded, soldered, is heated up by means of a not specifically defined heat source to enhance proper flow of the solder, a measure which is especially taken, if welding and soldering are separated either locally or with respect to the time at which welding and soldering occurs.

The German Pat. No. 714 669 proposes to resolve the problems mentioned above to coat the yet unjoined edges of the bodies with a lacquer then to solder these edges whereby the lacquer is chosen so that the soldering temperature provides for burning in of the lacquer.

This latter method which makes use of the same energy for joining the edges and for burning in the lacquer may not be used for welding-joint technique of the edges as the welding heat would not burn in the lacquer but would just burn the lacquer and provision of the lacquer would harm proper welding.

The German Pat. No. 750 056 and the European publication No. 0 120 810 disclose methods which provide for the application of a protecting layer from the inner side of the bodies after the edges of the bent bodies have been linked. This interior coating is, according to the European publication No. 0 120 810, afterwards burnt in whereby there is provided a heat source which acts from the exterior side on the finished hollow bodies.

As heating sources, inductive heaters, gas burner heaters or infrared radiators may be used. By the latter mentioned method the complete cylindrical body is brought on the burn in temperature level and is kept on that temperature for a predetermined time to provide for proper burning in. Especially when this method is used on hollow bodies of clean metal there occurs a high degree of heat reflection and the efficiency of the heat source acting from the exterior side on the body is accordingly bad with respect to the burn in target which is to be reached by provision of said heat source.

As concerns efficiency, the same considerations are valid if, for interior powder coating of the bodies to be coated, there is provided preheating from exterior with the object to enhance adhesion of the powder applied to the interior body walls. Here too exterior heating provides for heating of huge parts of the bodies and the heat capacity of the bodies provides for moving a high amount of heat into the region where coating means are provided so that this excessive heat may cause coating nozzles to be heated up as well, so that the coating powder may stick on such nozzles and affect their openings.

It is an object of the present invention at a method as mentioned above to apply the heat used pointed to an area where this heat is in fact necessitated. This object is reached by heating up the bodies before and/or after appliance of the coating directly from the body inner side.

For burning in coating there is thus directly applied burning-in heat to the body from its inner side after provision of the coating.

An apparatus to perform the inventive method comprises at the arm a heat source arrangement situated upstream and/or downstream of the coating arrangement.

By the inventive method as well as the according apparatus, the object is fulfilled that the heat applied is pointed directly on the interior surface of the bodies where it is in fact used.

A further advantage which is reached by the inventive method and the according apparatus is that thermal loading of the region just exterior from the bodies is kept much smaller as with known methods which use exterior heating, a fact which leads, besides of improving efficiency, further to the advantage that there may be provided at least between the coating arrangement and the burning-in heat source arrangement, in the region of coating, a continuous conveyer belt arrangement with at least one conveyer belt to move the bodies from the coating arrangement to the burn in heat source arrangement.

If heat is applied from the exterior of the bodies then a conveyer belt arrangement which continuously moves the body between the coating arrangement and the burn in heat source arrangement must be mounted on the opposite side of the bodies with respect to the heat source as is shown in the European publication No. 0 120 810 to prevent the conveyer belts to be too heavily thermically loaded by the heat sources or there must be taken as conveyer belt material expensive heat resistent material.

Because of the inventively pointed heat appliance the conveyer belt arrangement may be mounted in the coating region that is acting on the bodies in their seam region so that the degree of freedom for constructing an overall apparatus comprising e.g. a welding station, a coating station, a burn in station and conveyer means to convey the bodies from one to the other station, becomes considerably larger.

Preferably the heat source arrangement comprises at least one infrared radiator.

By providing a temperature measurement at the region of the arm, monitoring the temperature status during treatment of the bodies becomes possible.

Thereby preferably the result of said temperature measurement, a signal according to the momentarily temperature status, as a controlled output signal, is applied to an input for a controlled value of a temperature feedback control loop, which latter further comprises said heat source arrangement as adjusting member, so that there may be applied to the temperature feedback control loop a desired temperature value, as a control signal by means of an adjustable control signal generator unit and the controlled temperature value according to the temperature measurement is feedback controlled to stay on the temperature control value applied.

To further improve pointed heat appliance it is a further object of this invention to provide at said arm at least one reflector arrangement which concentrates the heat radiation of the heat source arrangement to a predetermined region or area of the bodies.

Preferably the heat source arrangement is arranged axially along a part of the arm and radially separated therefrom whereby said reflector arrangement comprises a reflecting groove arranged with respect to the source arrangement towards said arm, whereby said reflecting groove is preferably worked into the arm and is provided with a reflecting surface.

Considering the fact that can production as production of said hollow bodies occurs nowadays with speeds up to 650 cans/min., it becomes obvious that a reduction of the heat amount necessitated for the interior can coating to reach well defined results leads to tremendous savings with respect to energy, i.e. in both cases, either if the heat is applied to improve adhesion of a coating medium on the body walls or if the heat is applied to burn in a coating on the interior body side or if the heat is applied for both targets. The inventively pointed heat application and especially with said reflector arrangement provided, reduces heating up of the arm drastically so that additional problems of construction are resolved which occur by the fact that all feeding leads and pipes, as well for the coating arrangement as for the heat sources provided, e.g. electrical leads, run along the arm or within the arm whereby said pointed heat application prevents too high thermical loading of the arm and thus said leads are also uncritically loaded by heat.

Examples of preferred embodiments of the invention will now be described with the help of Figures.

DETAILED DESCRIPTION

Figure 1:
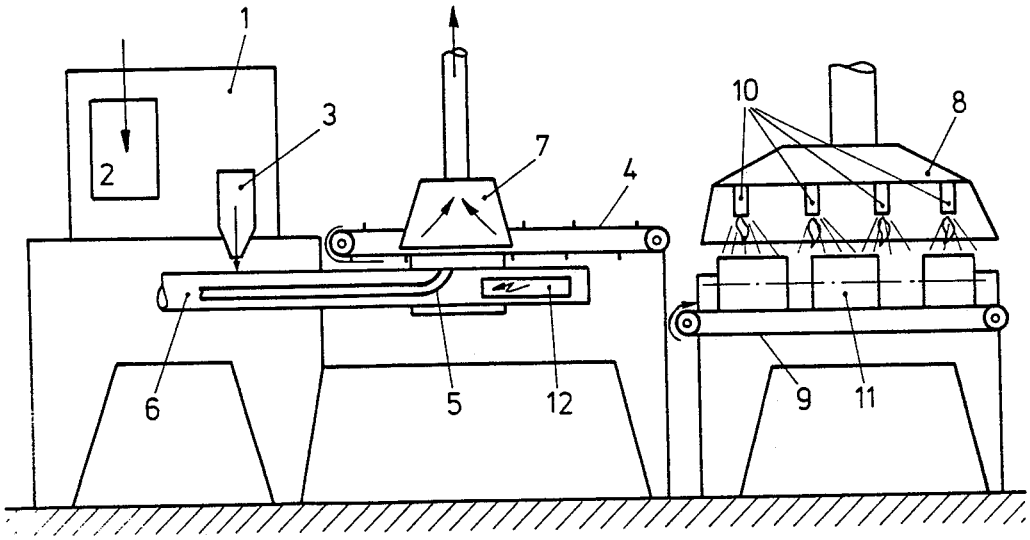
FIG. 1 a principle arrangement of a can manufacturing and coating apparatus with heat application according to well-known state of the art technique, FIG. 2 a section through a part of the apparatus according to FIG. 1 now with the inventive features, to perform the inventive method that is with a coating arrangement and a heat source arrangement on the arm, FIG. 3 a cross-sectional view of the arrangement according to FIG. 2 along line III—III, FIG. 4 a further inventive arrangement in section view with inventively arranged heat source arrangements for burn in of a coating and for preheating the bodies before being coated.

In FIG. 1 a general arrangement of a can welding and seam coating apparatus is shown as is today's state of the art thus without the inventive features. The can welding and coating arrangement 1 is fed with flat metal sheets 2 which latter are formed in a known manner to cylindrical parts, the opposing axial edges of which are welded at a welding unit 3. Forming of the still open metal bodies as well as welding of the opposed axial edges are not object of the present invention and are thus not described more in details. A conveyer belt 4 takes the hollow bodies i.e. the can bodies which are now moved riding over an arm or mandrel 6, which latter being provided with a coating unit with a tube 5 feeding a coating medium to the interior body surfaces and which is provided, as is known, with nozzles and a sucking unit 7 latter to collect coating medium which is lost between succeeding can bodies. After this coating the can bodies 11 are gripped by a further conveyer belt 9 which conveys the bodies through a burn in unit 8 where the bodies are heated up from their exterior sides with the help of burners, induction heaters, general heat sources 10.

The temperature of the bodies is maintained for a predetermined time by indirectly heating up the interior side of the coated weld-seam along a predetermined amount of way through which the bodies 11 run.

After having passed the burning in unit can bodies are gripped and handled by subsequent conveyer arrangements (not shown).

Figure 2:
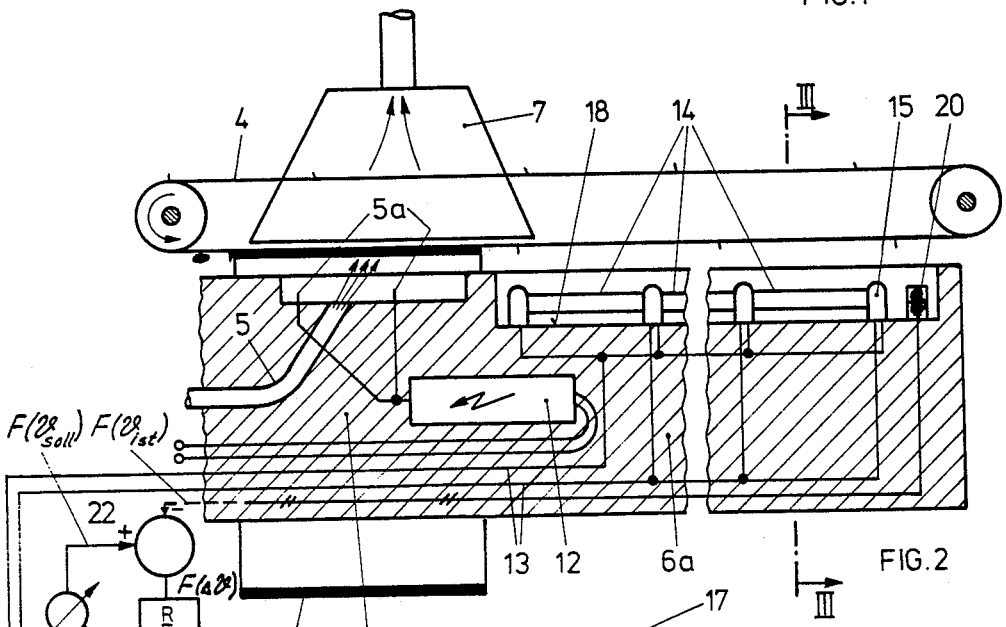
Figure 3:
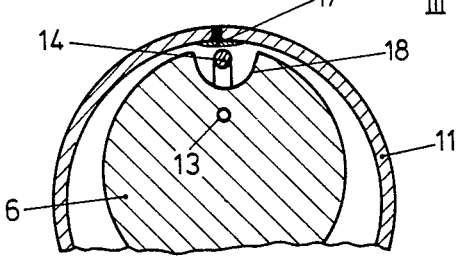

FIGS. 2 and 3 show the inventive features on an arm or mandrel 6 according to FIG. 1. The arm 6 which is commonly said a welding arm, comprises an extension part **6*a*, extending in direction of the movement of the bodies 11, i.e. downstream. The coating which is, as is known in the art, electrostatically supported, is realized via a feeding pipe 5 for the coating medium as for a powder or a lacquer and there is provided a high voltage generator 12 which applies a high electrostatic field between the can bodies and high field electrodes 5*a*. The high voltage generator 12 generates a voltage of e.g. about 60 kV. Subsequent the coating arrangement infrared radiators 14 are mounted on the extension 6*a* of the arm which may be one piece with arm 6. These infrared radiators 14 are electrically fed by feed cables 13 which are disposed along and within the arm 6 and its extension 6*a*. This is fascilitated by the fact that there is provided a pointed heating up of the coating film, a powder or lacquer film 17**, especially considering the fact that with such production apparatus, cylindrical bodies are manufactured down to a diameter of 40 to 60 mm.

A preferred embodiment of the invention is provided with a reflector 18 which is important for optimal functioning of such an apparatus whereby this reflector 18 is preferably integrated into the arm 6 and its extension **6*a*, respectively. This is shown in FIG. 3 where the reflector 18 is shown as a reflecting groove worked into the arm. With according geometrical layout e.g. with parabolic cross-section, according to the known rules of optics, the heat radiation of the radiators 14 is concentrated on an area B where the heat is necessitated and which eg. measures between about 5 and 25 mm. As the stick-like radiator 14 with a length of e.g. only 800 mm emits heat radiation of 3 kW there is thus applied a very high heat power per surface unit on the interior surface of the body 11**.

To further optimize burning in and hardening of the coating there is applied on above, or within the arm, generally in the region of the arm, a temperature measurement device. This measurement is performed for instance via an optical fibre optic indirectly or directly with the help of a pyrometer 20. The result signal of the temperature measurement i.e. a signal $F(\theta_{IST})$ as function of the momentarily temperature measured is compared at a comparing unit with a control signal $F(\theta_{SOLL})$ which latter is selected or adjusted at a selection unit 24. The electrical feeding energy, either its voltage or its current, for the radiators which energy is applied thereto via cables 13, is then adjusted according to control difference of the feedback control loop which accords to the momentarily difference of measured temperature and desired temperature $F(\Delta\theta)$. There is further provided a controller 26 as for instance a well-known thyristor controller to adjust operation of the infrared radiators 14 as adjusted elements within the temperature feedback control loop. Design of the controller, selection unit 24 and comparing unit 22 are well known to the man skilled in this art and are not further explained.

The arrangement of the temperature feedback control loop gives the possibility to have an accurate temperature control of the temperature of the coated seam, coated with a powder or lacquer coating. The required number of infrared radiators 14 as well as their axial length depends from conveying speed of the bodies 11 as well as from the hardening properties of the coating medium chosen for the coating 17.

Figure 4:
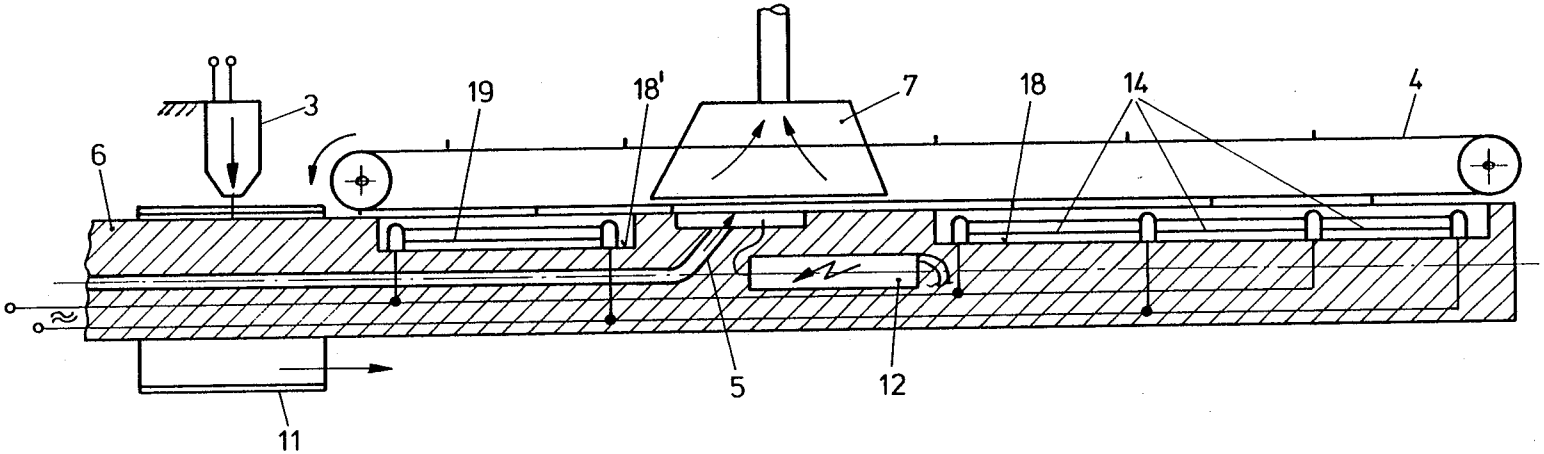

A further preferred embodiment according to the invention is shown in FIG. 4. Here upstream of the coating arrangement with the medium feeding pipe 5 there are provided one or several infrared radiators 19. Here too the heat radiation is concentrated with the help of reflectors 18' and is pointed on to a stripe along the interior surface of the can bodies 11 as was already explained with respect to radiators 14 in FIG. 3. By provision of heat sources upstream the coating unit the hollow bodies, here the can bodies, are preheated at their welding seam region and the efficiency of adhesion for a coating medium and especially for a coating powder is thus significantly improved. Thereby it is prevented that such an amount of heat is brought into the area of the coating arrangement that the nozzles thereof could be heated up which would lead to sticking of the coating medium thereon. Thus the powder or general coating medium amount per time unit may be reduced, as a greater part of this ejected powder or coating medium will stick on the inner surface of the bodies to reach a proper seam coating and this a powder recycling unit at the sucking unit 7 of FIG. 1 and sucking pumps (not shown) thereon will be less loaded.

I claim:

1. In a method for coating an interior area of a tubular body, which body is conveyed by conveyor means over a spray arm, and wherein a coatig medium is applied to the interior of said tubular body from said spray arm, and wherein heat is applied to said body at least one of before and after said coating medium has been applied to the tubular body for burning in the coating, the improvement comprising improving the heat-applying efficiency of burning in by the step of applying said heat from the interior at least predominately directly to at least one of an interior area of said body just before being coated and an interior area of said body already coated to burn in said coating.

2. A method according to claim 1, for coating a restricted area of said tubular body, wherein the step of applying heat includes directing the heat substantially to said restricted area of said tubular body.

3. A method according to claim 2, wherein said restricted area includes two edges of a sheet material joined to form said tubular body, and wherein said step of applying the coating medium comprises continuously applying the coating medium, and wherein said step of applying heat includes continuously applying heat to said joined area.

4. An apparatus for coating the interior of tubular bodies, the apparatus comprising:

a mandrel means introducible into at least one tubular body;

coating means on said mandrel means for applying a coating medium to an interior of said tubular body; and heating means on said mandrel means and arranged so as to predominately deliver heat directly from said mandrel means into a surrounding area toward said tubular body.

5. The apparatus according to claim 4, wherein said coating means comprises means for applying said coating medium into a restricted area, and wherein said heating means is aligned with said coating means on said mandrel means for delivering heat into said restricted area.

6. The apparatus according to claim 4, wherein said coating means and said heating means are spaced at a distance from each other along said mandrel means, and wherein a conveyor belt means including at least one conveyor belt is arranged partly parallel to and at a distance from said mandrel means, said at least one conveyor belt extending between an area in a vicinity of said coating means and an area in a vicinity of said heating means for conveying said tubular body between said areas along said mandrel means.

7. The apparatus according to claim 4, wherein said heating means extends axially of and along a portion of said mandrel means.

8. The apparatus according to claim 7, wherein said heating means includes a reflector means for concentrating said heat into a restricted area along said portion of said mandrel means.

9. The apparatus according to claim 7, wherein said heating means includes an axially extending groove of a reflecting surface on said mandrel means, said heating means being arranged along said groove.

10. The apparatus according to claim 9, wherein said groove is formed into said mandrel means.

11. The apparatus according to claim 4, further comprising means for measuring a temperature resulting from said heat delivered by said heating means.

12. The apparatus according to claim 11, further comprising a comparing unit, wherein an output of said temperature measuring means is supplied as a first input of the comparing unit, a second input of said comparing unit being supplied to a generator unit for a reference signal, an output of said comparing unit being supplied through a controller unit on a control input of said heating means to a feed-back control of said temperature measured on a value according to said reference signal.

* * * * *

UNITED STATES PATENT AND TRADEMARK OFFICE

CERTIFICATE OF CORRECTION

PATENT NO. : 4,759,946

DATED : July 26, 1988

INVENTOR(S) : Peter RIBNITZ

It is certified that error appears in the above-identified patent and that said Letters Patent is hereby corrected as shown below:

ON THE COVER PAGE

At item no. [22], in column 1, after "Filed:" change "Jul. 24, 1988" to read --July 24, 1986--.

Signed and Sealed this

Fourteenth Day of February, 1989

*Attest:*

DONALD J. QUIGG

*Attesting Officer*

*Commissioner of Patents and Trademarks*